United States Patent [19]

Kildea et al.

[11] Patent Number: 4,637,514

[45] Date of Patent: Jan. 20, 1987

[54] THERMOFORMED PLASTIC WRAP DISPENSER

[75] Inventors: James M. Kildea, Midland, Mich.; Maria D. Bedner, Erie, Pa.; John J. Gulick, Midland, Mich.

[73] Assignee: The Dow Chemical Company, Midland, Mich.

[21] Appl. No.: 743,835

[22] Filed: Jun. 12, 1985

[51] Int. Cl.[4] ..... B65D 13/00; B65D 85/672

[52] U.S. Cl. ..... 206/406; 206/408; 206/409; 220/4 E; 220/335

[58] Field of Search ..... 220/4 E, 335, 4 B, 334; 206/398, 399, 402–409

[56] References Cited

U.S. PATENT DOCUMENTS

| | | | |
|---|---|---|---|
| 3,134,525 | 5/1964 | Holcombe | 206/409 |
| 3,156,356 | 11/1964 | McConnell | 206/409 |
| 3,310,353 | 3/1967 | Cordis | 206/409 |
| 3,477,624 | 11/1969 | Branyon et al. | 206/409 |
| 3,718,251 | 2/1973 | Barnett | 206/409 |
| 4,034,926 | 7/1977 | Wegner | 206/409 |
| 4,187,639 | 2/1980 | Ono | 220/4 E |
| 4,191,307 | 3/1980 | Le Caire, Jr. et al. | 206/409 |
| 4,240,544 | 12/1980 | Barnhart et al. | 220/4 E |

*Primary Examiner*—Joseph Man-Fu Moy

*Attorney, Agent, or Firm*—L. E. Hessenaur, Jr.

[57] ABSTRACT

A one-piece thermoformed plastic wrap dispenser is provided for containing and dispensing sheet wrapping material such as plastic film. The dispenser includes an elongated body having a pair of like confronting hollow body shells. Each of the body shells has a pair of adjacent longitudinal edges interconnected by an integral hinge. There are also confronting longitudinal edges. Each body shell has a cross-section of an isosceles triangle whereby the body has a square cross-section. The body shells also have end walls with confronting pairs thereof having means for retaining such end walls in confronting relation. An integral cutting member is hingedly connected to the confronting longitudinal edge of one of the body shells by an integral hinge and lies closely adjacent to a side wall of the other body shell.

13 Claims, 18 Drawing Figures

FIG. 1
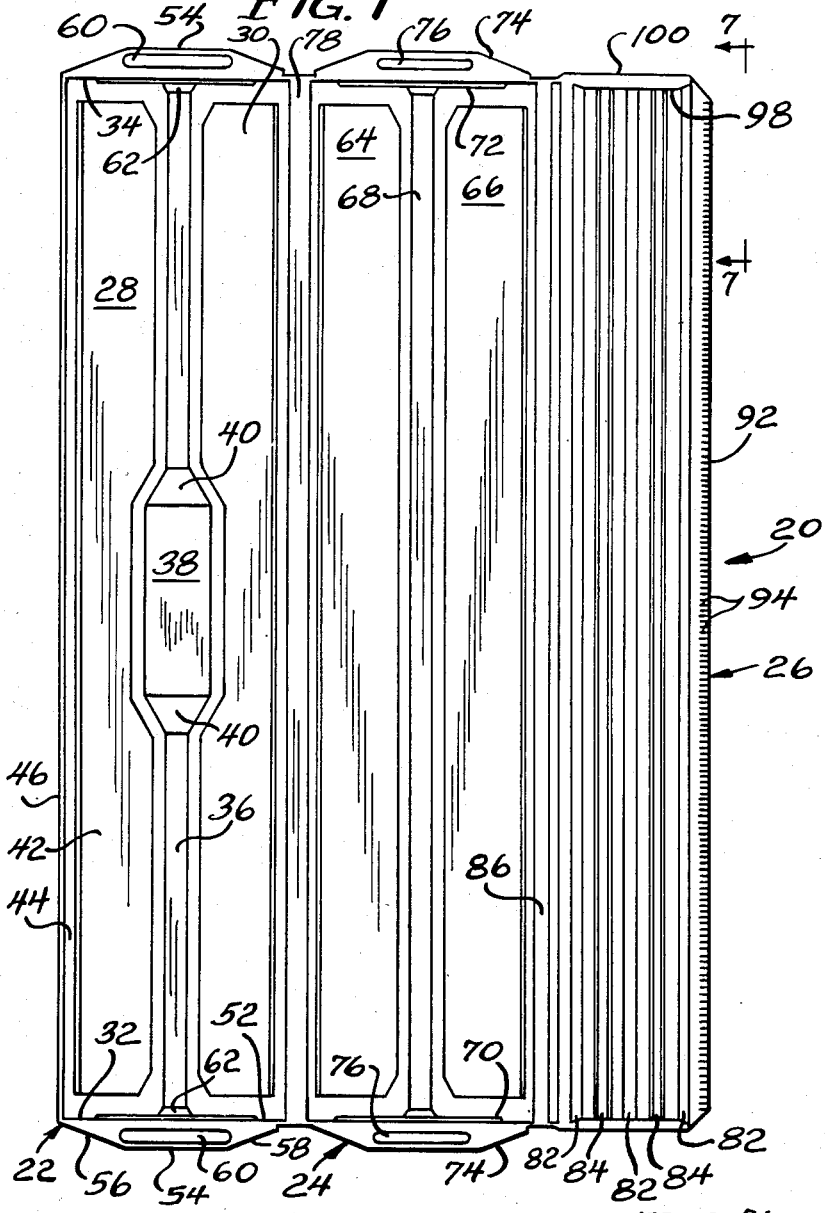
FIG. 7
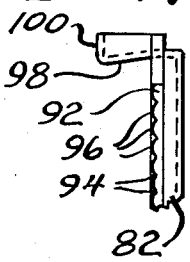
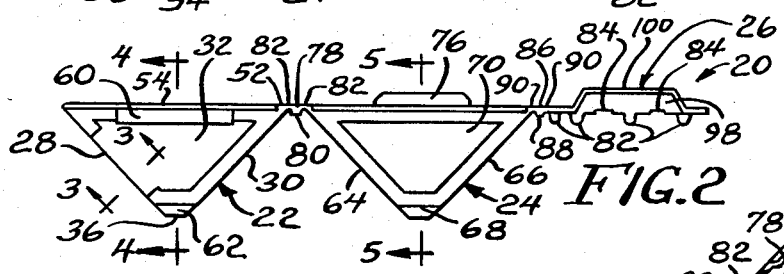
FIG. 2
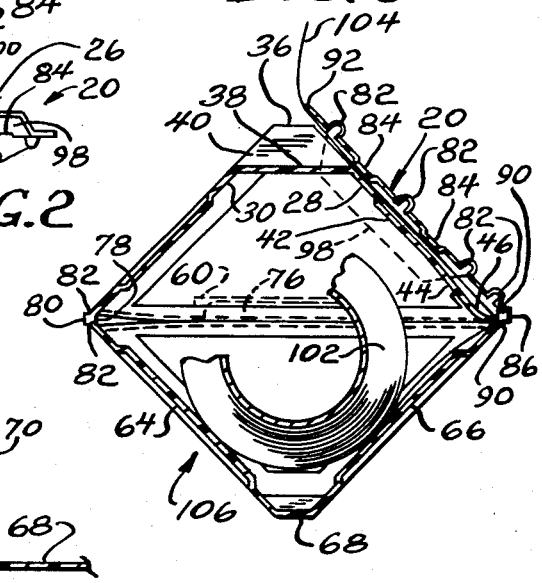
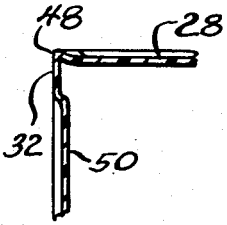
FIG. 3
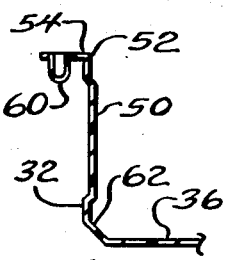
FIG. 4
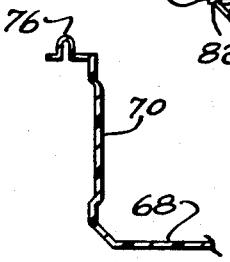
FIG. 5
FIG. 6

FIG. 11
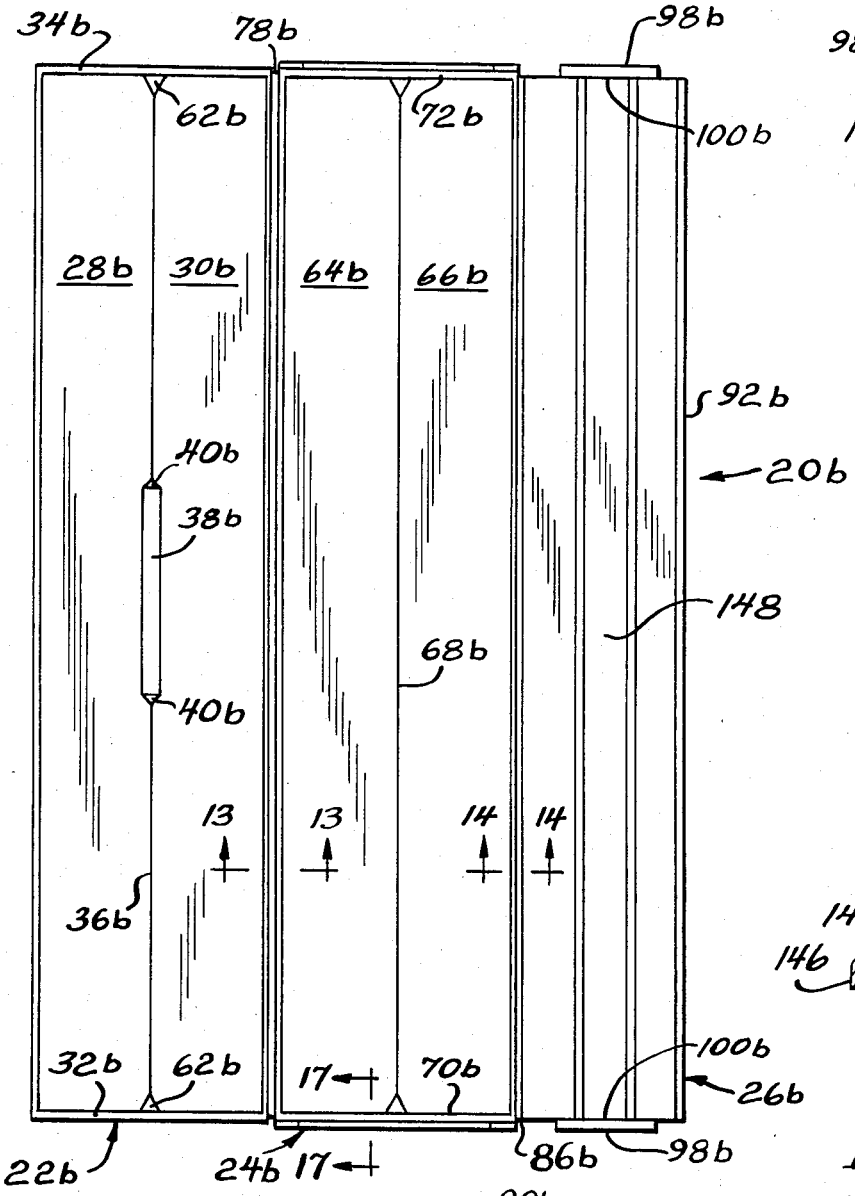
FIG. 16
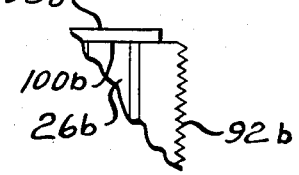
FIG. 17
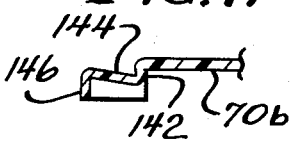
FIG. 18
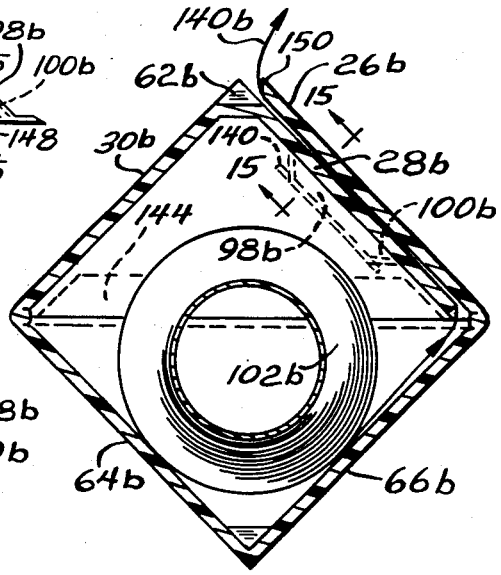
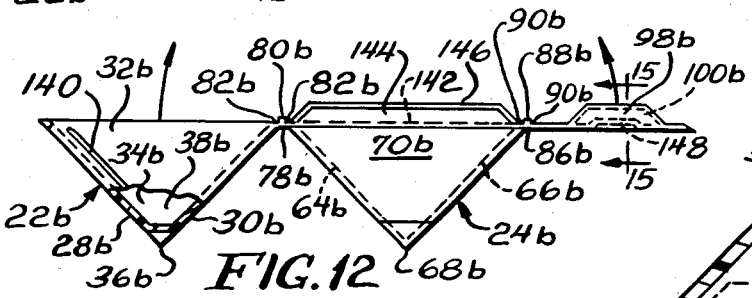
FIG. 12
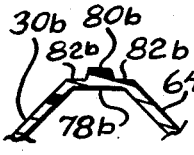
FIG. 13
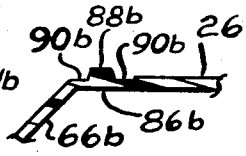
FIG. 14
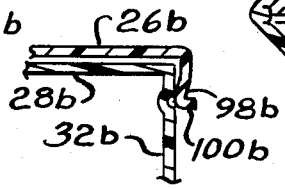
FIG. 15

THERMOFORMED PLASTIC WRAP DISPENSER

BACKGROUND OF THE INVENTION

Flexible wrapping materials such as plastic film and waxed paper are conventionally supplied in pasteboard cartons. A roll of the wrapping material is housed within the carton and is intended to rotate as one pulls on the material at the end of the roll, thereby to dispense the material necessary for wrapping a package, which may be leftover food, etc. The pasteboard carton is provided with a metal cutting edge, generally serrated for cutting off the desired quantity of wrapping material when it has been withdrawn from the carton.

Such dispensing cartons have proved to be unduly expensive as compared with the contents of the carton. Several individual stages of production are necessary, all of which increase the cost. These stages include die cutting and scoring of the blanks, stamping of the metal cutter bar, crimping bar onto each blank, set-up and gluing operations, and finally filling the container. Each such stage increases the cost of the carton or container, and hence of the item as sold.

Furthermore, it occasionally occurs that a user will cut a finger on the metal cutter bar. This cutter bar is stamped of thin sheet metal, and is quite sharp. Such cutting is uncomfortable, unsightly and potentially dangerous.

OBJECTS AND SUMMARY OF THE PRESENT INVENTION

It is an object of the present invention to provide a carton for film or sheet packaging material such as film plastic, wax paper, aluminum foil, etc., which is completely formed in one stage.

More particularly, it is an object of the present invention to provide such a container which is thermoformed of a suitable plastic material.

Yet another object of the present invention is to provide a thermoformed plastic carton for dispensing of sheet packaging material in which a cutting edge is formed integrally with the remainder of the container in the same operation.

In carrying out the foregoing and other objects of the present invention we provide a thermoformed elongated structure comprising two integral convex-concave shells each of triangular cross-section plus an integral flap having a formed cutting edge thereon. The two triangular shells are interconnected by an integral hinge, and the shells are foldable into face-to-face relation to form a container of substantially square cross-section. Structure is provided at the opposite ends of these shells to hold them in the aforesaid face-to-face relation.

A flap is joined to one of the triangular sections by an integral hinge, and it is foldable into confronting relation with one side of one of the triangular shells, the integral hinge overlying the open juncture between the triangular shells. Structure on the flap interfits with structure on the adjacent triangular shell for holding the flap in closed condition, whereby flexible packaging material such as film plastic is held in position for access for subsequent withdrawal.

THE DRAWINGS

The invention will best be understood from the following specification when taken in connection with the accompanying drawings, wherein:

FIG. 1 is a plan or lay-out view of a thermoformed plastic wrap dispenser before folding into closed condition;

FIG. 2 is an end view thereof;

FIG. 3 is an enlarged sectional view taken along the line 3—3 in FIG. 2;

FIG. 4 is an enlarged sectional view taken along the line 4—4 in FIG. 2;

FIG. 5 is an enlarged sectional view taken along the line 5—5 in FIG. 2;

FIG. 6 is an enlarged cross-sectional view through the dispenser as folded in to using shape and including a roll of sheet packaging material such as plastic film;

FIG. 7 is a detail view of the latch for the tear-off flap as taken substantially along the line 7—7 in FIG. 1;

FIG. 11 is a lay-out or plan view similar to FIG. 1 showing a further modification of the invention;

FIG. 12 is an end view of the modification of FIG. 11;

FIG. 13 is an enlarged cross-sectional view as taken along the line 13—13 in FIG. 11;

FIG. 14 is an enlarged cross-sectional view as taken along the line 14—14 in FIG. 11;

FIG. 15 is a detail view showing the latching of the cut-off flap in closed position as taken along the line 15—15 with the dispenser folded into closed, operating position;

FIG. 16 is a detail view of a corner of the cut-off flap on an enlarged scale;

FIG. 17 is an enlarged sectional view as taken substantially along the line 17—17 in FIG. 11; and FIG. 18 is a cross-sectional view on an enlarged scale similar to FIGS. 6 and 7 but showing the embodiment of FIG. 11.

DETAILED DISCLOSURE OF THE ILLUSTRATED EMBODIMENT

Figure 8:
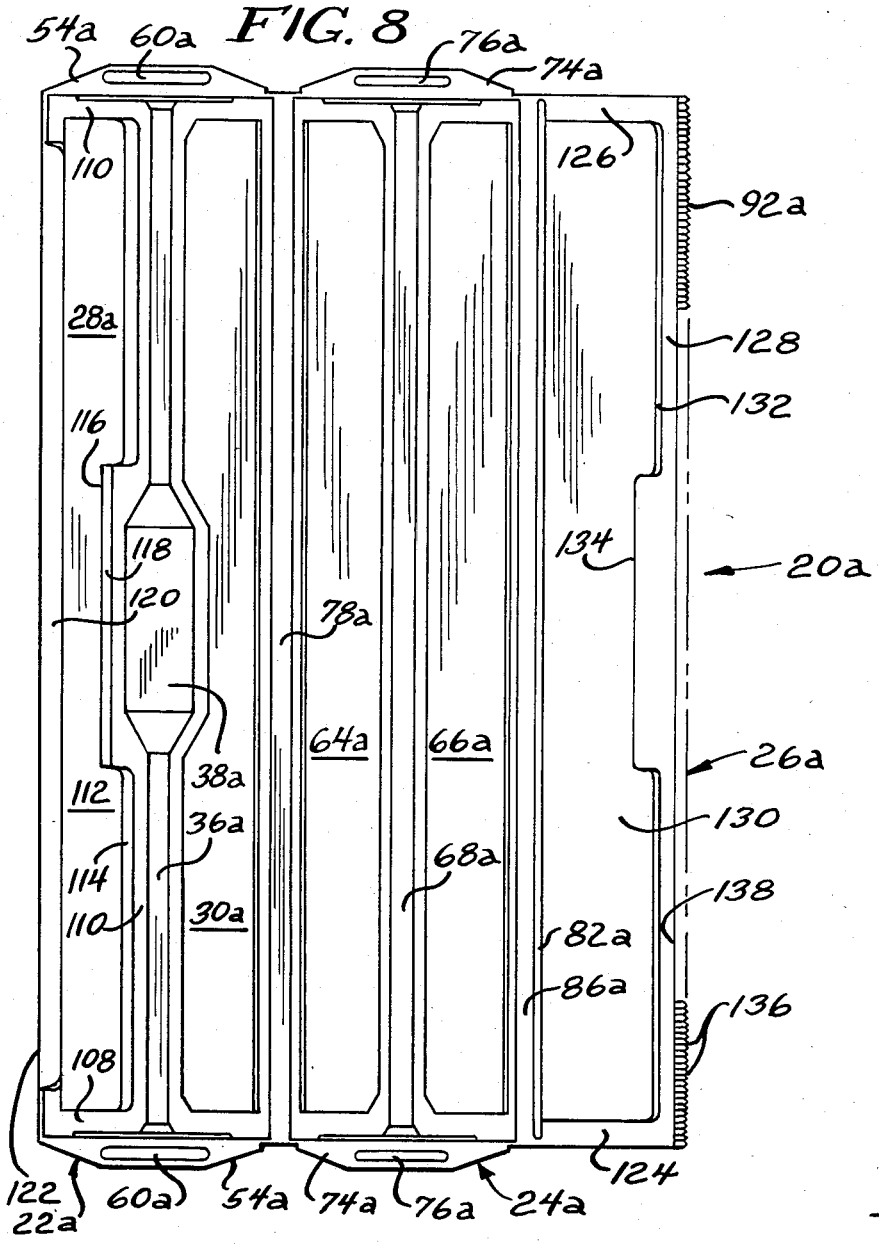
FIG. 8 is a lay-out or plan view similar to FIG. 1 showing a modified form of the invention.

Turning now in greater specificity to the drawings, and first to FIGS. 1 and 2 there is shown a thermoformed plastic wrap dispenser 20 in non-assembled or knock-down form comprising a first convex-concave body shell 22 having a cross-section of an isosceles triangle, a second convex-concave isosceles triangle body shell 24, and a substantially flat retention and tear-off flap 26. The thermoforming art is well-known, and it will be understood that a sheet of suitable plastic is heat softened to a desirable degree and then conformed to a female mold by gravity and differential air pressure. The three parts of the knock-down dispenser are simultaneously formed in a common mold, and the three parts are integral with one another as will be set forth in detail hereinafter.

The first body shell 22 comprises a pair of sidewalls 28 and 30, and a pair of end walls 32 and 34. The sidewalls 28 and 30 are at right angles to one another and are integrally interconnected by a relatively narrow corner wall 36 which is arranged at 45 to either wall 28, 30. Midway from end-to-end the corner wall 36 is depressed and widened at 38 to form a recess (see also FIG. 6) for easy gripping of a plastic film or the like dispensed from the dispenser as will be brought out in detail hereinafter. The recess or depression 38 is connected by tapered sections 40 to the corner wall 36.

The sidewall 28 is nominally flat, but is provided with a first depressed portion or panel 42 for rigidity, and a second depressed and inclined panel 44 having at its free edge an outwardly curled lip 46.

The end wall 32 is joined to the first sidewall 28 at a substantially right angle 48 (FIG. 3). The end wall 32 has a recessed panel 50 for strength and rigidity and which opens to the side wall 28 to provide for clearance of a retaining flange on the flap 26 as will be apparent hereinafter.

The outer edge 52 of the end wall (the base of the isosceles triangle) is provided with an outwardly projecting right angle flange 54 tapering in at its ends 56 and 58. The flange is provided with an elongated trough or depression 60 overlapping the end wall 32.

The end wall 34 is a mirror image of the end wall 32 and includes a similar flange 54 and trough or recess The narrow wall 36 is joined to both of the end walls 32 and 34 by an angled section 62 which facilitates molding and provides a more secure and rigid corner.

The second body shell 24 need not be described in detail, since it is very similar to the first body shell 22, having first and second recessed sidewalls 64 and 66 interconnected by a narrow wall 68. The second body shell 24 is provided with recessed end walls 70 and 72, and tapered flanges 74 are provided on both end walls, the flanges having upward protuberances 76. The protuberances 76 are similar to but smaller than the troughs or recesses 60 and are dimensioned to have an interference fit therewith.

The sidewall 30 of the first body shell 22 is integrally joined to the sidewall 64 of the second body shell 24 by a hinge strip 78. The hinge strip 78 as best seen in FIG. 2 comprises a central rib 80 running from end-to-end thereof, and thinner areas 82 lying on either side thereof and immediately adjacent the respective body shells. This construction localizes the bending or hinging effect so that there is a localized 90 bend in each narrow side strip 82 in bringing the end wall edges substantially into engagement with the flanges 54 contacting the flanges 74, and with the protuberances 76 received in the recesses or troughs 60 as shown in FIG. 6.

The film retention and cut-off flap 26 is substantially flat, and is provided with a plurality of external ribs 82 extending from end-to-end thereof. The flap is also provided with depressions 84 extending from end-to-end of the flap. These ribs and depressions strengthen the flap and render it more rigid.

The adjacent edge of the flap 26 is joined to the sidewall 66 of the second body shell 24 by an integral hinge 86 similar to the hinge 78, comprising a central rib 88 and two narrow flexing sections 90. Each of these flexing sections has to bend only 45° as may be seen with reference to FIG. 6 to bring the flap 26 into proximity with the sidewall 28 of the first body shell 22.

The free edge 92 of the flap 26 is straight from end-to-end, and on its outer surface is flat. However, the inner surface is provided with a large number of parallel transverse indentations 94 (FIGS. 1 and 7) essentially defining a serrated edge having a plurality of cutting teeth 96 thereon.

The flap 26 is completed by provision at each end of a flange 98 projecting inwardly from the flap 26 at slightly less than 90. A narrow peripheral flange 100 strengthens the flange 98 and renders it more rigid.

The body shells 22 and 24 are hingedly moved toward one another with a roll of sheet wrapping material 102 therein as shown in FIG. 6. This sheet wrapping material preferably is a plastic film but could be wax paper, aluminum foil, or other suitable material. The body shells are brought into confronting relationship with the protuberances 76 received in the troughs 60 to hold the body shells together with some of the sheet wrapping material 100 extending past the lip 46 and out far enough that the flap 20 can be brought into substantially contacting relation with the adjacent sidewall 28, the flanges 98 gripping the end walls 32 and 34 frictionally to hold the flap in the position shown in FIG. 6. The end 104 of the plastic film or other sheet wrapping material 102 extends past the edge 92 of the flap. Thus, as much wrapping material as desired may be pulled from the roll, and then torn off along the edge 92. Transverse pressure on the edge outwardly away from the dispenser tends to bow the edge slightly outwardly, and this pulls the end flanges 98 into tighter engagement with the end walls of the first body shell 22. The completed thermoplastic wrap dispenser with the wrapping or packaging material therein is identified by numeral 106.

Figure 9:
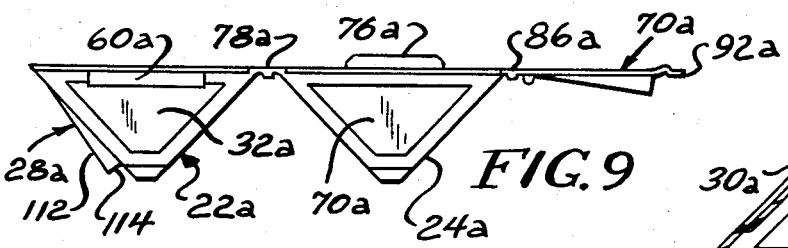
FIG. 9 is an end view thereof.
Figure 10:
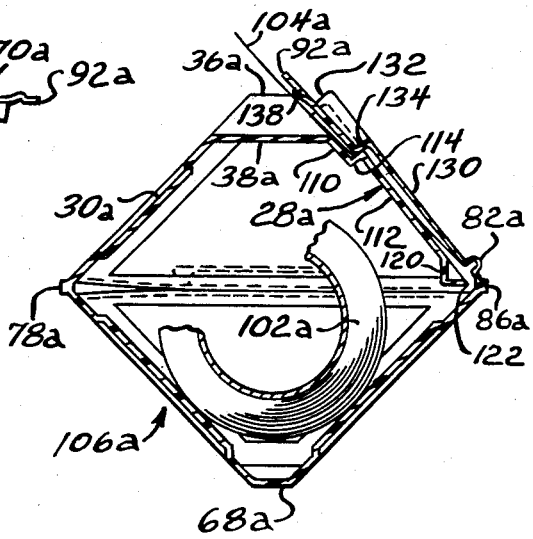
FIG. 10 is a view similar to FIG. 6 showing the modified form of the invention as illustrated in FIGS. 8 and 9.

A modification of the invention is shown in FIGS. 8–10 which is similar to the embodiment previously described in connection with FIGS. 1–7. Similar parts are identified by like numerals with the addition of the suffix a to avoid prolixity of disclosure. Differences reside in the sidewall **28*a* and in the retention and tear-off flap 20*a*** as now will be described.

The ends of the sidewall **28*a* as identified at 108, and the interconnecting portion 110 lying along the narrow connecting wall 36*a* are substantially flat and coplanar. A panel 112 upstands from the coplanar portions 108, 110 providing a substantially right-angle wall 114. The panel 112 and wall 114 are recessed at 116 and 118, to provide clearance for the recess 38*a*. The panel 112 slopes from the top of the wall 114 nearly to the free edge of the sidewall 28*a*, the sidewall at this position being formed as a V-shaped trough 120 having a free edge 122**.

The flap **26*a* is formed to conform to the outer surface of the sidewall 28*a*. specifically, it has a flat, coplanar periphery comprising end sections 124 and 126, and an edge portion 128. Adjacent to the hinge 86*a* there is a single longitudinally extending stiffening rib, and from the edge of this rib a panel 130 extends outwardly at a shallow angle, being terminated by a right-angle wall 132. The central portion of the wall 132 is recessed at 134** as is the panel in this area.

The outer edge **92*a* of the flap 20*a* is serrated in outline as may be seen at 136, and these serrations extend both above and below the plane 128, thereby to provide a superior cutting edge. An offset 138 extending from end-to-end of the flap is provided inwardly from the edge 92*a*** to enhance the strength and rigidity of the edge portion of the flap.

As will be seen in FIG. 10, the plastic film 104 or other sheet material is gripped between the conforming right-angle walls 134 and 114 of the flap and the sidewall, whereby more positively to hold the film in place after an extracted portion thereof has been torn off. The flap must be pivoted slightly outwardly to free the film so that more film may be withdrawn past the edge 122, the flap again being brought into gripping position with the sidewall before the film is torn off, whereby to hold the film against any possible retraction.

A third form of the invention is shown in FIGS. 11–18. Most of the parts again are the same or nearly so, and similar parts are identified by like numerals with the addition of the suffix b. In this embodiment of the invention the dispenser **20*b* includes somewhat similar construction than in the previous embodiments. Thus, in the body shell 22*b* the sidewalls 28*b* and 30*b* are flat throughout and meet at a right-angle corner 36*b* rather than at champfered corners. The relief area 38*b* for gripping the plastic film or other sheet material is substantially smaller. The end walls 32*b* and 34*b* are flat with the exception of elongated indentations 140 adjacent to and parallel to the sidewall 28*b***. The purpose for these indentations will be set forth hereinafter.

The sidewalls **64*b* and 66*b* also are flat throughout and meet at a right-angle corner 68*b* rather than having a cut-off corner as in the previous embodiments. The end walls 70*b* and 72*b* are flat, and at the free or base edges are provided with outward offsets 142 and then outwardly extending and inwardly angled flanges 144 reinforced by peripheral flanges 146. When the body shells are folded into confronting relation as shown in FIG. 18 with a roll of sheet wrapping material 102*b* therein the flanges 144 frictionally grip the end walls 32*b* and 34*b*** to hold the dispenser in closed position.

The first and second body shells **22*b* and 24*b* are interconnected by an integral hinge 78*b* similar to that disclosed in connection with the previous embodiments of the invention, but having the projection or rib 80*b*** directed upwardly or inwardly, the opposite of the previous embodiments.

The flap **26*b* is mostly flat, and is provided with an end-to-end central channel 148 to strengthen and render the flap more rigid. The flap is provided at the opposite ends with flanges 98*b* similar to those described in connection with FIGS. 1–7. The outer end of each flange is received within the indentation 180 of the respective end walls 32*b* and 34*b* as shown in FIG. 15 to hold the flap in the closed position of FIG. 18 with the end of the plastic film 104** extending therepast.

The edge **92*b* is sharp as provided by a taper 150 shown in FIG. 18. Alternatively, as shown in FIG. 16** the edge may be serrated for improved tearing.

There are many plastic resin materials which could be utilized to manufacture the thermoformed plastic wrap dispenser as herein shown and described. One material that we have found to be satisfactory is high impact polystyrene. A sheet of such polystyrene having a thickness of 0.035 inch has been used as stock, resulting in an average wall thickness of 0.020 to 0.025 inch.

The plastic thermoformed dispenser, carton or container as heretofore shown and described presents many advantages over contemporary commercial containers made of pasteboard with a metal cutter bar. Considerable expense is saved in eliminating the cutter bar, a manufacturing step is avoided in having an integral rather than an attached cutter, and the plastic cutting edge as herein shown is much less likely to cut the fingers of a user than is the current metal cutter bar which causes a significant number of injuries.

A friction fit or interference fit of the retention and cutting flap in the present dispenser holds the end of the supply of plastic film in readily accessible position after a portion of the film has been torn off for use. This eliminates the need of a separate adhesive application as found in current cartons. The placement of the ridges on the inside of the flap in one embodiment augments the holding ability of the flap.

The diagonal separation of the two body shells permits the retention and cut-off flap to be hinged to an edge of the body so that the flap overlies an adjacent surface of the carton.

In addition, the diagonal division coupled with the thermoforming process allows the dispenser to be formed as a result of a single operation. Excluding the possibility of printing material, the container is complete and ready to fill directly after the single stage forming/trimming operation. The plastic material eliminates problems associated with current pasteboard or the like stock which is subject to moisture absorption. Current cartons also require gluing, forming, and metal cutting bar attachment in separate operations in production, all of which increase the complexity and cost of production.

The thermoformed dispenser or carton is readily adapted for a nesting of parts in a production plant before the body shells are folded into confronting relation with an enclosed roll of plastic film or the like. Furthermore, the thermoformed dispenser or carton as herein shown and described can be re-used, thereby making it possible to sell bulk rolls of plastic film to be inserted in a used carton.

The specific examples of the invention as herein shown and described are for illustrative purposes only. Various changes in structure will no doubt occur to those skilled in the art and will be understood as forming a part of the present invention insofar as they fall within the spirit and scope of the appended claims.

The invention is claimed as follows:

1. A one-piece thermoformed dispensing carton for a roll of sheet material for wrapping, comprising an elongated one-piece thermoformed body of plastic resin material including a pair of confronting hollow body shells having adjacent longitudinal edges interconnected by an integral hinge and further having confronting longitudinal edges, said body shells having pairs of elongated side walls and pairs of end walls, the end walls being arranged in confronting pairs from one body shell to the other, the end walls of said confronting pairs having interengageable integral retaining means thereon for retaining said pairs of end walls in confronting relation, at least one of each interengageable means comprising a flange extending from the respective end wall, an integral cutter member comprising a flap having an edge elongated with said side walls and hingedly interconnected to a confronting longitudinal edge of one of said body shells by an integral hinge and overlying a side wall of that body shell and having an opposite integral serrated cutting edge of plastic resin material, and latching means on said flap interfitting with a part of said body to hold said flap in close proximity to the side wall which it overlies to hold sheet material between said flap and the side wall which it overlies.

2. A carton as set forth in claim 1 wherein each body shell has a cross-section substantially in the shape of a triangle, the pair of body shells together having a substantially quadrilateral cross-section.

3. A carton as set forth in claim 1 wherein the retaining means comprises an outwardly projecting flange on each end wall, the projecting flange of one end wall having a recess therein and the projecting flange of the adjacent end wall having a projection thereon interfitting with said recess.

4. A carton as set forth in claim 3 wherein said flanges are perpendicular to the respective end walls.

5. A carton as set forth in claim 1 wherein said retaining means comprises a flange on each end wall of one body shell substantially parallel to and projecting beyond the respective end wall and engaging the corresponding end wall of the opposite body shell.

6. A carton as set forth in claim 1 wherein the latching means comprise an outwardly projecting shoulder on a body sidewall and a mating shoulder on said flap wedgedly engaging the side wall shoulder, said shoulders together gripping said sheet material therebetween.

7. A carton as set forth in claim 1 wherein said latching means comprise end flanges on said flap engageable with respective end walls of a body shell.

8. A carton as set forth in claim 7 wherein the respective end walls are provided with indentations engaged by said flanges.

9. A carton as set forth in claim 1 wherein as intermediate portion of said body is relieved, and said flap cutting edge projects beyond said releived to permit portion gripping of sheet material between said flap and said body.

10. A dispensing carton as set forth in claim 1 wherein said serrated cutting edge has height variation for superior cutting action and added strength.

11. A dispensing carton as set forth in claim 10 wherein said cutting edge is at the surface alternately up and down relative to an adjacent portion of said cutter member.

12. A dispensing carton as set forth in claim 11 wherein edge material of said cutting member is in an up-and-down zig-zag configuration relative to an adjacent cutter member portion.

13. A dispensing carton as set forth in claim 11 wherein said up-and-down configuration is produced by a variation in thickness of the material adjacent said edge.

* * * * *

UNITED STATES PATENT AND TRADEMARK OFFICE

CERTIFICATE OF CORRECTION

PATENT NO. : 4,637,514

DATED : January 20, 1987

INVENTOR(S) : James M. Kildea, Maria D. Bedner, John J. Gulick

It is certified that error appears in the above-identified patent and that said Letters Patent is hereby corrected as shown below:

Column 1, line 47, "the same operation." should read --the same forming operation.--.

Column 3, line 22, "trough or recess" should read --trough or recess 60.--.

Column 4, line 46, "specifically," should read --Specifically,--.

Column 4, line 54, "flap 20a is" should read --flap 26a is--.

Column 5, line 7, "similar" should read --simpler--.

Column 7, line 19, "wherein as interme-" should read --wherein an interme --.

Column 8, line 1, "said releived to permit portion" should read --relieved portion to permit--.

Signed and Sealed this

Nineteenth Day of January, 1988

*Attest:*

DONALD J. QUIGG

*Attesting Officer*

*Commissioner of Patents and Trademarks*